United States Patent [19]

Gruner et al.

[11] 4,140,300

[45] Feb. 20, 1979

[54] SUPERVISING CASTING FLOW

[75] Inventors: Hans Gruner; Karlheinz Koch, both of Duisburg; Josef Glaser, Düsseldorf; Hartwig Matzner, Duisburg, all of Fed. Rep. of Germany

[73] Assignee: Mannesmann Aktiengesellschaft, Düsseldorf, Fed. Rep. of Germany

[21] Appl. No.: 825,029

[22] Filed: Aug. 16, 1977

[30] Foreign Application Priority Data

Aug. 17, 1976 [DE] Fed. Rep. of Germany ..... 2637421

[51] Int. Cl.[2] ..... B22D 11/10

[52] U.S. Cl. ..... 266/45; 164/4; 164/155; 222/590; 266/78; 266/100

[58] Field of Search ..... 164/4, 150, 154, 155; 222/590, 591, 603; 266/45, 78, 80, 90, 93, 94, 95, 99, 100

[56] References Cited

U.S. PATENT DOCUMENTS 3,838,727 10/1974 Levi et al. ..... 164/4

FOREIGN PATENT DOCUMENTS 1030548 5/1966 United Kingdom ..... 164/155

1379236 1/1975 United Kingdom ..... 222/590

*Primary Examiner*—Roy Lake

*Assistant Examiner*—Paul A. Bell

*Attorney, Agent, or Firm*—Smyth, Pavitt, Siegemund, Jones & Martella

[57] ABSTRACT

A stream of molten metal is monitored as to emitted radiation to detect the onset of inclusion of slag for stopping the stream.

5 Claims, 1 Drawing Figure

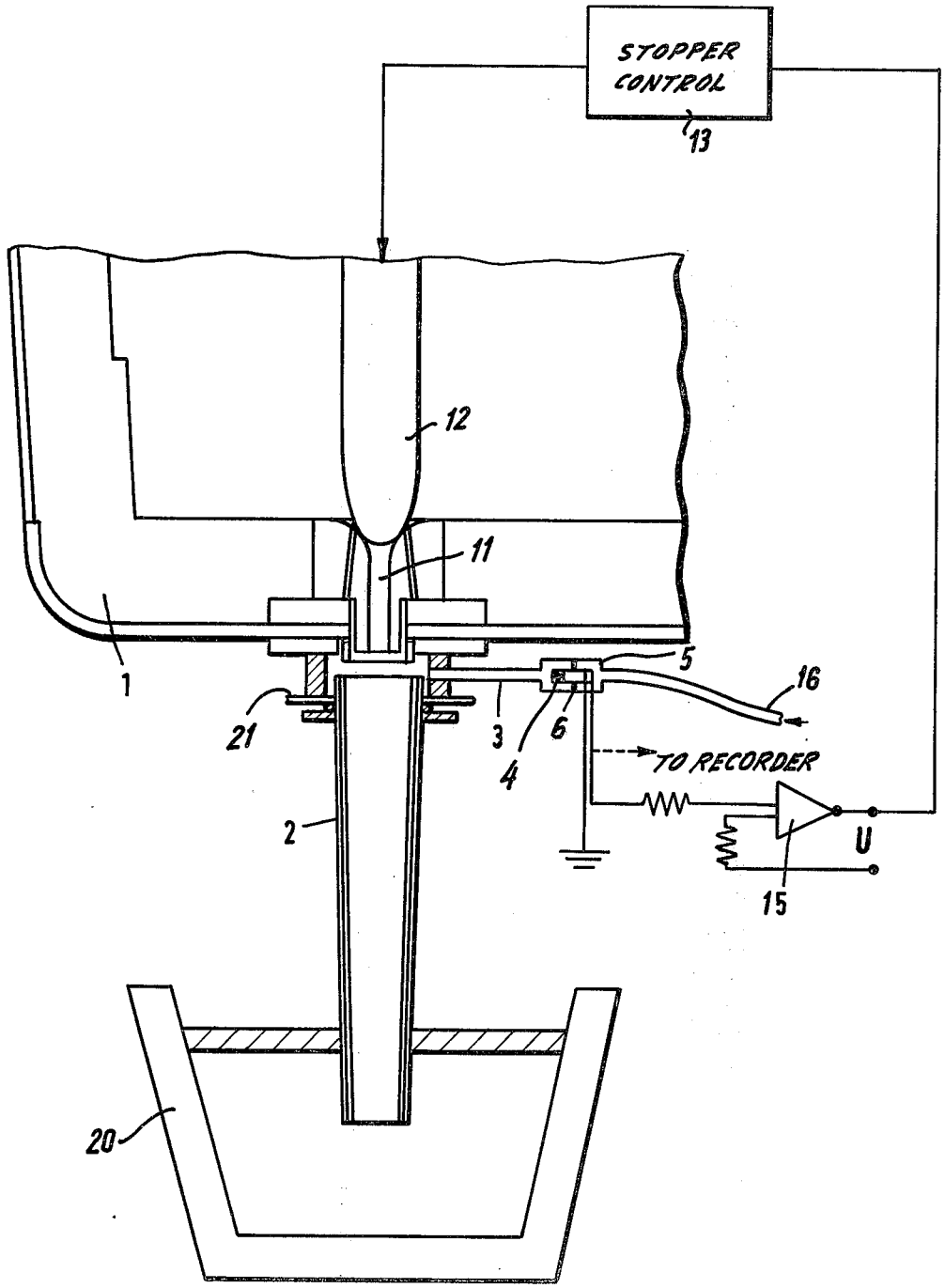
STOPPER CONTROL
13
12
11
1
5
16
21
3
6
4
TO RECORDER
2
U
15
20

SUPERVISING CASTING FLOW

BACKGROUND OF THE INVENTION

The present invention relates to a method and equipment for supervising the discharge of molten metal from a vessel, particularly as to the impending end of casting metal; the stream of molten metal may pour from a casting ladle, tundish or other casting vessels, through a protective tube, the vessel having a controlled discharge opening.

Casting of metal under utilization of a vessel with a bottom opening through which the metal pours freely permits experienced personnel to ascertain just from the color of the pouring stream when the end of the casting is about to approach; the bottom opening has to be closed as soon as slag intermingles with the poured metal. Of course, such slag should be prevented from participating in the casting.

In accordance with recent developments in casting an effort has been made to better protect the stream of pouring metal against reoxidation in air and a cover tube has been used which extends between the molten metal in the mold or the tundish and the discharge opening of the ladle. Accordingly, it is no longer possible to just observe the color of the stream of molten metal. However, the problem of avoiding the flow of slag into the tundish or mold remains just the same. This is particularly true for example whenever several ladies are emptied into a tundish for continuous casting in one or several molds; the fire proof material in the tundish is particularly prone to be attacked by slag. Therefore, entry of slag in the tundish has to be avoided even though direct observation of the stream is not possible.

One can, of course, indirectly ascertain when the ladle is about to empty by tracking its weight but that kind of indication is not a particularly accurate one. Therefore, it was found necessary in such case to prematurely shut off the ladle to make sure that slag will not pour into the tundish or into the mold. In other words, one had to operate with a relatively high margin of safety amounting to a waste of considerable quantities of molten metal that remains in the ladle and is still usable but is in fact now discharged with the slag as waste.

DESCRIPTION OF THE INVENTION

It is an object of the present invention to provide a new and improved method and equipment for observing and monitoring a covered stream of molten metal on the basis of objective criteria.

It is another object of the invention to detect the onset of inclusion of slag in a stream of molten metal pouring from a casting vessel.

In accordance with the preferred embodiment of the present invention, it is suggested to monitor the radiation intensity as emitted by a stream of molten metal just as it leaves the bottom of the casting vessel (ladle, tundish, etc.) and to utilize the change of that intensity as it occurs as soon as slag is included in the casting stream. The intensity and its change of the emitted radiation is detected by means of a suitable radiation detecting element such as a photo-diode or photo transistor producing electrical signals indicative of that intensity and its change, and that electrical signal is used directly or indirectly to terminate the casting process. Directly terminating refers to the operation of an automatic feedback loop in which the signal level and its changes control the position and displacement of a stopper for a bottom opening of the vessel through which the stream pours; as the intensity of the radiation changes due to slag inclusions, the end of casting is signalled therewith, and the stopper is automatically lowered to close the opening and to terminate the flow of metal. An indirect method involves the utilization of that electrical signal to drive an indicating instrument, a recorder or the like so that such indication can be used by operating personnel to manually shut off the casting vessel.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

The FIGURE shows somewhat schematically a device in which the inventive method is being practiced.

Proceeding now to the detailed description of the drawing, the FIGURE shows the ladle 1 with a conventional discharge outlet 11 which can be closed by a stopper or plunger 12 operated in the usual known manner, by means of a stopper control 13. The stopper control, being in effect a stopper drive, can be triggered manually or automatically, the latter mode of operation will be explained shortly.

Molten metal is to be discharged from the ladle 1 into a mold or tundish 20; the particular contour of that vessel 20, its specific purpose and function is not important as far as practicing the invention is concerned. Decisive is that molten metal is to be poured from one vessel, 1, into another one, 20. Conventionally, the stream of molten metal will pour in a free stream through the opening 11 into the vessel 20. However, it was mentioned above that in newer types of equipment a protective pipe or tube such as tube 2 is mounted in registery with the opening 11 to the bottom of vessel 1 so that the metal will pour through a protective, i.e. non-oxidizing environment as established in the tube or pipe 2. A connecting structure 21 permits exchangeable connection of the tube 2 to the bottom of the ladle 1. The structure 21 includes in addition sealing means so that in fact the space through which the stream of metal pours is substantially free from oxygen.

The connecting structure 21 is in addition provided with a small, straight tube 3 extending at right angle to the direction of flow of the pouring stream. The front end or inner end of that tube 3 faces the stream of molten metal as it pours through the opening 11 and as it is just about to enter the protective tube 2. A wider chamber 5 is provided at the other end of the tube 3. Chamber 5 contains a plug element 6 in which is mounted a light sensitive element 4 which responds to the radiation emanating from the basically enclosed, pouring stream of metal.

It was found that the inherent and emitted (black body) radiation of the hot, pouring stream of metal undergoes a sufficiently pronounced intensity change on account of spectral differences in behavior as far as black body radiation is concerned when the metal begins to include slag particles. The light sensitive element 4 which is being used is preferably one which has a very high sensitivity to light and, possibly, a non-uniform spectral sensitivity (enhanced through an appropriate filter) so that the inclusion of slag in the pouring metal produces a significant change in the effective output of that element 4. One may use here a photo diode or photo transistor which is deemed to be the preferred element to be used. Moreover, it was found to be of advantage to use a photo transistor in collector-emitter circuit.

As light hits the P-N transition of the semi-conductor element as exposed, charge carrier pairs are being produced in a number which is a measure of the intensity of the radiation to be ascertained, and producing a voltage drop in the circuit. As the stream of pouring metal begins to include some slag a noticeable change in intensity and voltage drop in the diode or transistor circuit is produced. That change in voltage is used as a signal which is used as a direct or indirect control signal for closing vessel 1 via stopper drive 13.

The direct control will involve a differential amplifier 15 having one input for example biased to a particular signal level. The bias is selected as a reference so that the output of the differential amplifier 15 remains zero or is at a low level as long as the voltage furnished by the signalling element 4 indicates a radiation intensity accompanying the normal stream of metal. The amplifier 5 is preferably being constructed as operational amplifier to rapidly change its output when the element 4 signals a radiation change. The bias adjustment determines the tolerance range for such a response. The amplifier 15 will provide a high output signal when element 4 signals "slag inclusion," which output is used as control signal for operating device 13 so that, in fact, the stopper 12 closes the ladle 1.

Stopper control on the basis of an operational feedback loop as described may not be necessary in all instances. A simplified (indirect) method of stopper control could be used exclusively or as an accompanying back up method. The output signal from the photo detector 4 may be fed to a recorder which will provide a particular recording output as long as regular casting operation is in progress, but upon exceeding a particular response threshold to which the recorder circuit is attuned by proper adjustment, a limit contact may close in the recorder circuit and the indication may, in fact jump to a different output producing a very clear and visible indication which is being recorded and is therefore indicative of the termination of the casting flow. Conceivably the output of the amplifier 5 could be plotted or otherwise indicated (a buzzer may sound, etc.). In either case, the operator may intervene and manually trigger the stopper drive 13 to close the discharge opening of the ladle. It is also conceivable that one plots the actual signal from element 4.

In view of the temperatures involved, it is necessary to continuously cool the semi-conductor element; therefore the chamber 5 is connected to a hose 16 which in turn is connected to a suitable source of cooling gas such as pressurized air or just nitrogen or, better still, argon. The utilization of an inert gas such as nitrogen or argon may, in fact, be instrumental in the generation of a protective gas atmosphere around the stream of molten metal. The plug 6 may have ducts accordingly.

The invention is not limited to the embodiments described above but all changes and modifications thereof not constituting departures from the spirit and scope of the invention are intended to be included.

We claim:

1. Method of supervising the discharge of molten metal from a casting vessel through a protective tube having a side duct, comprising the steps of:

detecting the radiation intensity of the metal as poured from the vessel through said tube, by observing through the side duct the metal as poured; and using a change in detected radiation intensity as indication of inclusion of slag in the metal as poured and observed.

2. Method as in claim 1, wherein the using step includes closing a pouring outlet of the vessel.

3. Apparatus for supervising the discharge of molten metal from a casting vessel through a protective tube, comprising:

a lateral duct extending from but open to the interior of said protective tube permitting observation of the metal as poured through the tube;

a radiation sensitive element disposed at said lateral duct for detecting the radiation intensity of the metal as poured from the vessel through said tube; and means being responsive to a change in detected radiation intensity as indication of inclusion of slag in the metal as poured.

4. Apparatus as in claim 3, the means being responsive, including means for automatically closing a pouring outlet of the vessel.

5. Apparatus as in claim 3, including means connected to the duct for cooling the element.

* * * * *